US010190196B2

(12) United States Patent
Hosch et al.

(10) Patent No.: US 10,190,196 B2
(45) Date of Patent: Jan. 29, 2019

(54) 6XXX ALUMINUM ALLOYS

(71) Applicant: ALCOA INC., Pittsburgh, PA (US)

(72) Inventors: Timothy A. Hosch, Plum, PA (US); Russell S. Long, Murrysville, PA (US)

(73) Assignee: ARCONIC INC., Pittsburgh, PA (US)

( * ) Notice: Subject to any disclaimer, the term of this patent is extended or adjusted under 35 U.S.C. 154(b) by 302 days.

(21) Appl. No.: 14/599,229

(22) Filed: Jan. 16, 2015

(65) Prior Publication Data

US 2015/0203942 A1 Jul. 23, 2015

Related U.S. Application Data

(60) Provisional application No. 61/929,673, filed on Jan. 21, 2014.

(51) Int. Cl.

| | |
|---|---|
| ***C22C 21/02*** | (2006.01) |
| ***C22F 1/043*** | (2006.01) |
| ***C22C 21/08*** | (2006.01) |
| *C22C 21/00* | (2006.01) |
| *C22F 1/04* | (2006.01) |

(52) U.S. Cl.

CPC ..... *C22C 21/08* (2013.01); *C22C 21/02* (2013.01)

(58) Field of Classification Search

CPC .. C22F 1/043; C22F 1/047; C22F 1/05; C22C 21/02; C22C 21/04; C22C 21/06; C22C 21/08

See application file for complete search history.

(56) References Cited

U.S. PATENT DOCUMENTS

| | | | | |
|---|---|---|---|---|
| 3,717,512 | A | 2/1973 | Gullotti et al. | 148/32.5 |
| 4,065,326 | A | 12/1977 | Nicoud | 148/550 |
| 4,256,488 | A | 3/1981 | Livak | |
| 4,525,326 | A | 6/1985 | Schwellinger et al. | 420/535 |
| 4,605,448 | A | 8/1986 | Baba et al. | 148/537 |
| 4,637,842 | A | 1/1987 | Jeffrey et al. | 148/535 |
| 5,690,758 | A | 11/1997 | Oh et al. | 148/700 |
| 6,267,922 | B1 | 7/2001 | Bull et al. | 420/534 |
| 6,361,741 | B1 | 3/2002 | Klemp et al. | 420/535 |
| 6,375,767 | B1 | 4/2002 | Parson et al. | 148/518 |
| 6,440,359 | B1 | 8/2002 | Parson et al. | 420/544 |
| 6,565,679 | B1 | 5/2003 | Jeffrey et al. | 148/417 |
| 6,630,037 | B1 | 10/2003 | Sawada et al. | 148/417 |
| 7,182,825 | B2 | 2/2007 | Unal et al. | 148/551 |
| 2001/0037844 | A1 | 11/2001 | Bekki et al. | 148/440 |
| 2004/0079457 | A1 | 4/2004 | Kimura et al. | 148/693 |
| 2005/0000609 | A1* | 1/2005 | Butler, Jr. | C22C 21/02 148/702 |
| 2008/0318081 | A1 | 12/2008 | Steins | 428/640 |
| 2009/0116999 | A1 | 5/2009 | Furu et al. | 420/535 |
| 2012/0055591 | A1 | 3/2012 | Kamat et al. | 148/551 |
| 2014/0000768 | A1 | 1/2014 | Sawtell et al. | 148/551 |
| 2014/0017116 | A1* | 1/2014 | Lin | C22C 21/08 420/535 |
| 2014/0366998 | A1 | 12/2014 | Kamat et al. | 148/551 |

FOREIGN PATENT DOCUMENTS

| | | |
|---|---|---|
| CN | 103131904 | 6/2013 |
| EP | 2156945 | 2/2010 |
| JP | 11-310841 | 11/1999 |
| JP | 2000-345272 | 12/2000 |
| JP | 2002-105573 | 4/2002 |
| JP | 2008-019483 | 1/2008 |
| JP | 2009-041045 | 2/2009 |
| JP | 2010-116591 | 5/2010 |
| JP | 2012-1756 | 1/2012 |

OTHER PUBLICATIONS

ANSI H35.1/ H35.1(M)-2009 (Revision of ANSI H35.I / H35.1(M)-2006), "American National Standard Alloy and Temper Designation Systems for Aluminum," pp. 1-11, The Aluminum Association (2009).

International Search Report and Written Opinion, dated Apr. 21, 2015, from corresponding, co-owned International Patent Application No. PCT/US2015/011815.

Rack, H. J., et al., "Thermomechanical Treatment of High Purity 6061 Aluminum" *Metallurgical Transactions A* 8A:335-346, Feb. 1977.

Registration Record Series Teal Sheets, *International Alloy Designations and Chemical Composition Limits for Wrought Aluminum and Wrought Aluminum Alloys*, The Aluminum Association, pp. 1-27, Feb. 2009.

Registration Record Series Teal Sheets, *International Alloy Designations and Chemical Composition Limits for Wrought Aluminum and Wrought Aluminum Alloys—New Alloys*, The Aluminum Association, Addendum, Feb. 2014, 3 pages.

First Office Action, dated Oct. 10, 2017, from related Chinese Patent Application No. CN201580005362.2.

Supplemental European Search Report, dated Oct. 5, 2017, from corresponding European Patent Application No. 15740588.7.

* cited by examiner

*Primary Examiner* — Lois L Zheng

(74) *Attorney, Agent, or Firm* — Greenberg Traurig, LLP

(57) ABSTRACT

New 6xxx aluminum alloys having an improved combination of properties are disclosed. The new 6xxx aluminum alloy generally include from 0.30 to 0.53 wt. % Si, from 0.50 to 0.65 wt. % Mg wherein the ratio of wt. % Mg to wt. % Si is at least 1.0:1 (Mg:Si), from 0.05 to 0.24 wt. % Cu, from 0.05 to 0.14 wt. % Mn, from 0.05 to 0.25 wt. % Fe, up to 0.15 wt. % Ti, up to 0.15 wt. % Zn, up to 0.15 wt. % Zr, not greater than 0.04 wt. % V, and not greater than 0.04 wt. % Cr, the balance being aluminum and other elements.

20 Claims, No Drawings

6XXX ALUMINUM ALLOYS

CROSS-REFERENCE TO RELATED APPLICATION

This patent application claims benefit of priority of U.S. Provisional Patent Application No. 61/929,673, filed Jan. 21, 2014, entitled "6XXX Aluminum Alloys", which is incorporated herein by reference in its entirety.

BACKGROUND

Aluminum alloys are useful in a variety of applications. However, improving one property of an aluminum alloy without degrading another property often proves elusive. For example, it is difficult to increase the strength of an alloy without decreasing its corrosion resistance. Other properties of interest for aluminum alloys include formability and critical fracture strain, to name two.

SUMMARY OF THE DISCLOSURE

Broadly, the present disclosure relates to new 6xxx aluminum alloys having an improved combination of properties, such as an improved combination of strength, critical fracture strain, formability, and/or corrosion resistance, among others.

Generally, the new 6xxx aluminum alloys have from 0.30 to 0.53 wt. % Si, from 0.50 to 0.65 wt. % Mg wherein the ratio of wt. % Mg to wt. % Si is at least 1.0:1 (Mg:Si), from 0.05 to 0.24 wt. % Cu, from 0.05 to 0.14 wt. % Mn, from 0.05 to 0.25 wt. % Fe, up to 0.15 wt. % Ti, up to 0.15 wt. % Zn, up to 0.15 wt. % Zr, not greater than 0.04 wt. % V, and not greater than 0.04 wt. % Cr, the balance being aluminum and other elements.

The amount of silicon (Si) and magnesium (Mg) in the new 6xxx aluminum alloys may relate to the improved combination of properties (e.g., strength, crush properties). Generally, the new 6xxx aluminum alloy includes from 0.30 to 0.53 wt. % Si. In one embodiment, a new 6xxx aluminum alloy includes at least 0.35 wt. % Si. In another embodiment, a new 6xxx aluminum alloy includes at least 0.375 wt. % Si. In yet another embodiment, a new 6xxx aluminum alloy includes at least 0.40 wt. % Si. In another embodiment, a new 6xxx aluminum alloy includes at least 0.425 wt. % Si. In one embodiment, a new 6xxx aluminum alloy includes not greater than 0.50 wt. % Si. In another embodiment, a new 6xxx aluminum alloy includes not greater than 0.475 wt. % Si. In one embodiment, a target amount of silicon in a new 6xxx aluminum alloy is 0.45 wt. % Si.

Generally, the new 6xxx aluminum alloy includes from 0.50 to 0.65 wt. % Mg. In one embodiment, a new 6xxx aluminum alloy includes at least 0.525 wt. % Mg. In another embodiment, a new 6xxx aluminum alloy includes at least 0.55 wt. % Mg. In yet another embodiment, a new 6xxx aluminum alloy includes at least 0.575 wt. % Mg. In one embodiment, a new 6xxx aluminum alloy includes not greater than 0.625 wt. % Mg. In one embodiment, a target amount of magnesium in a new 6xxx aluminum alloy is 0.60 wt. % Mg.

Generally, the new 6xxx aluminum alloy includes silicon and magnesium such that the wt. % of Mg is equal to or greater than the wt. % of Si, i.e., the ratio of wt. % Mg to wt. % Si is at least 1.0:1 (Mg:Si). In one embodiment, the ratio of wt. % Mg to wt. % Si is at least 1.05:1(Mg:Si). In another embodiment, the ratio of wt. % Mg to wt. % Si is at least 1.10:1(Mg:Si). In yet another embodiment, the ratio of wt. % Mg to wt. % Si is at least 1.20:1(Mg:Si). In another embodiment, the ratio of wt. % Mg to wt. % Si is at least 1.30:1(Mg:Si). In one embodiment, the ratio of wt. % Mg to wt. % Si is not greater than 1.75:1(Mg:Si). In another embodiment, the ratio of wt. % Mg to wt. % Si is not greater than 1.65:1(Mg:Si). In yet another embodiment, the ratio of wt. % Mg to wt. % Si is not greater than 1.55:1(Mg:Si). In another embodiment, the ratio of wt. % Mg to wt. % Si is not greater than 1.45:1(Mg:Si). In one embodiment, a target ratio of wt. % Mg to wt. % Si in a new 6xxx aluminum alloy is 1.33:1 (Mg:Si).

The amount of copper (Cu) in the new 6xxx aluminum alloys may relate to the improved combination of properties (e.g., corrosion resistance, strength). Generally, the new 6xxx aluminum alloy includes from 0.05 to 0.24 wt. % Cu. In one embodiment, a new 6xxx aluminum alloy includes not greater than 0.22 wt. % Cu. In another embodiment, a new 6xxx aluminum alloy includes not greater than 0.20 wt. % Cu. In yet another embodiment, a new 6xxx aluminum alloy includes not greater than 0.19 wt. % Cu. In another embodiment, a new 6xxx aluminum alloy includes not greater than 0.17 wt. % Cu. In one embodiment, a new 6xxx aluminum alloy includes at least 0.07 wt. % Cu. In another embodiment, a new 6xxx aluminum alloy includes at least 0.09 wt. % Cu. In yet another embodiment, a new 6xxx aluminum alloy includes at least 0.11 wt. % Cu. In another embodiment, a new 6xxx aluminum alloy includes at least 0.13 wt. % Cu. In one embodiment, a target amount of copper in a new 6xxx aluminum alloy is 0.15 wt. % Cu.

The amount of manganese (Mn) in the new 6xxx aluminum alloys may relate to the improved combination of properties (e.g., formability, by controlling grain structure). Generally, the new 6xxx aluminum alloy includes from 0.05 to 0.14 wt. % Mn. In one embodiment, a new 6xxx aluminum alloy includes at least 0.06 wt. % Mn. In another embodiment, a new 6xxx aluminum alloy includes at least 0.07 wt. % Mn. In yet another embodiment, a new 6xxx aluminum alloy includes at least 0.08 wt. % Mn. In one embodiment, a new 6xxx aluminum alloy includes not greater than 0.13 wt. % Mn. In another embodiment, a new 6xxx aluminum alloy includes not greater than 0.12 wt. % Mn. In one embodiment, a target amount of manganese in a new 6xxx aluminum alloy is 0.10 wt. % Mn.

Iron (Fe) is generally included in the new 6xxx aluminum alloy as an impurity, and in the range of from 0.05 to 0.25 wt. % Fe. In one embodiment, a new 6xxx aluminum alloy includes at least 0.10 wt. % Fe. In another one embodiment, a new 6xxx aluminum alloy includes at least 0.15 wt. % Fe. In one embodiment, a new 6xxx aluminum alloy includes not greater than 0.225 wt. % Fe. In yet another embodiment, a new 6xxx aluminum alloy includes not greater than 0.20 wt. % Fe.

Titanium (Ti) may optionally be present in the new 6xxx aluminum alloy, such as for grain refining purposes. In one embodiment, a new 6xxx aluminum alloy includes at least 0.005 wt. % Ti. In another embodiment, a new 6xxx aluminum alloy includes at least 0.010 wt. % Ti. In yet another embodiment, a new 6xxx aluminum alloy includes at least 0.0125 wt. % Ti. In one embodiment, a new 6xxx aluminum alloy includes not greater than 0.10 wt. % Ti. In another embodiment, a new 6xxx aluminum alloy includes not greater than 0.08 wt. % Ti. In yet another embodiment, a new 6xxx aluminum alloy includes not greater than 0.05 wt. % Ti. In one embodiment, a target amount of titanium in a new 6xxx aluminum alloy is 0.03 wt. % Ti.

Zinc (Zn) may optionally be included in the new alloy, and in an amount up to 0.15 wt. % Zn. Zinc may be present in scrap, and its removal may be costly. In one embodiment, a new alloy includes not greater than 0.10 wt. % Zn. In another embodiment, a new alloy includes not greater than 0.05 wt. % Zn.

Zirconium (Zr) may optionally be included in the new alloy, and in an amount up to 0.15 wt. % Zr. When present, zirconium may inhibit recrystallization. In one approach, a new 6xxx aluminum alloy includes 0.05-0.15 wt. % Zr. In another approach, zirconium is not purposefully used. In one embodiment, a new 6xxx aluminum alloy includes not greater than 0.10 wt. % Zr. In another embodiment, a new 6xxx aluminum alloy includes not greater than 0.05 wt. % Zr.

Both vanadium (V) and chromium (Cr) are preferentially avoided in the new 6xxx aluminum alloy. Such elements are costly and/or can form detrimental intermetallic particles in the new 6xxx aluminum alloy. Thus, the new 6xxx aluminum alloy generally includes not greater than 0.04 wt. % V and not greater than 0.04 wt. % Cr. In one embodiment, a new 6xxx aluminum alloy includes not greater than 0.03 wt. % V. In another embodiment, a new 6xxx aluminum alloy includes not greater than 0.02 wt. % V. In one embodiment, a new 6xxx aluminum alloy includes not greater than 0.03 wt. % Cr. In another embodiment, a new 6xxx aluminum alloy includes not greater than 0.02 wt. % Cr.

As noted above, the balance of the new aluminum alloy is aluminum and other elements. As used herein, "other elements" includes any elements of the periodic table other than the above-identified elements, i.e., any elements other than aluminum (Al), Si, Mg, Cu, Mn, Fe, Ti, Zn, Zr, V, and Cr. The new aluminum alloy may include not more than 0.10 wt. % each of any other element, with the total combined amount of these other elements not exceeding 0.30 wt. % in the new aluminum alloy. In one embodiment, each one of these other elements, individually, does not exceed 0.05 wt. % in the aluminum alloy, and the total combined amount of these other elements does not exceed 0.15 wt. % in the aluminum alloy. In another embodiment, each one of these other elements, individually, does not exceed 0.03 wt. % in the aluminum alloy, and the total combined amount of these other elements does not exceed 0.10 wt. % in the aluminum alloy.

Except where stated otherwise, the expression "up to" when referring to the amount of an element means that that elemental composition is optional and includes a zero amount of that particular compositional component. Unless stated otherwise, all compositional percentages are in weight percent (wt. %).

The new 6xxx aluminum alloy may be used in all wrought product forms. In one embodiment, a new 6xxx aluminum alloy is a rolled product. For example, the new 6xxx aluminum alloys may be produced in sheet form. In one embodiment, a sheet made from the new 6xxx aluminum alloy has a thickness of from 1.5 mm to 4.0 mm.

In one embodiment, the new 6xxx aluminum alloys are produced using ingot casting and hot rolling. In one embodiment, a method includes the steps of casting an ingot of the new 6xxx aluminum alloy, homogenizing the ingot, rolling the ingot into a rolled product having a final gauge (via hot rolling and/or cold rolling), solution heat treating the rolled product, wherein the solution heat treating comprises heating the rolled product to a temperature and for a time such that substantially all of $Mg_2Si$ of the rolled product is dissolved into solid solution, and after the solution heat treating, quenching the rolled product (e.g., cold water quenching). After the quenching, the rolled product may be artificially aged. In some embodiments, one or more anneal steps may be completed during the rolling (e.g., hot rolling to a first gauge, annealing, cold rolling to the final gauge). The artificially aged product can be painted (e.g., for an automobile part), and may thus be subjected to a paint-bake cycle. In one embodiment, the rolled aluminum alloy products produced from the new alloy may be incorporated in an automobile.

In another embodiment, the new 6xxx aluminum alloys products are cast via continuous casting. Downstream of the continuous casting, the product can be (a) rolled (hot and/or cold), (b) optionally annealed (e.g., between hot rolling and any cold rolling steps), (c) solution heat treated and quenched, (d) optionally cold worked (post-solution heat treatment), and (e) artificially aged, and all steps (a)-(e) may occur in-line or off-line relative to the continuous casting step. Some methods for producing the new 6xxx aluminum alloys products using continuous casting and associated downstream steps are described in, for example, U.S. Pat. No. 7,182,825, U.S. Patent Application Publication No. 2014/0000768, and U.S. Patent Application Publication No. 2014/0366998, each of which is incorporated herein by reference in its entirety. The artificially aged product can be painted (e.g., for an automobile part), and may thus be subjected to a paint-bake cycle.

DETAILED DESCRIPTION

Example 1—Industrial Scale Testing

Two industrial scale ingots were cast (one invention and one comparison), then scalped, and then homogenized. The compositions of the ingots are provided in Table 1, below. The ingots were then hot rolled to an intermediate gauge, then annealed at 800° F. for 1 hour, and then cold rolled to final gauge (2.0 mm). The rolled products were then solution heat treated at a temperature and for a time such that substantially all of $Mg_2Si$ of the rolled product was dissolved into solid solution. The rolled products were then immediately cold water quenched, and then naturally aged and artificially aged for various periods, as described below. Mechanical properties were then tested, including tensile yield strength (TYS), ultimate tensile strength (UTS), tensile elongation (T. Elong.), ultimate elongation (U. Elong.), and critical fracture strain (CFS), the results of which are shown in Tables 2-3. Mechanical properties including TYS, UTS, T. Elong. and U. Elong. were either tested in accordance with ASTM E8 and B557, or using a tapered version of the ASTM B557 specimen. Critical fracture strain (CFS) was derived from an engineering stress v. strain curve generated from the above described tests. Using the stress v. strain curve, the engineering strain at maximum load ($\varepsilon_m$), the engineering stress at maximum load ($\delta_m$) and the engineering stress at the fracture load ($\delta_f$) were determined and then entered into the following equation to provide the critical fracture strain (CFS):

$$CFS = -\ln\left(\frac{\delta_f/\delta_m}{(1+\varepsilon_m)^{1/2}}\right)$$

The CFS may be multiplied by 100 to convert from units of strain to units of percent (%). Corrosion resistance per ASTM G110 was also measured, the results of which are shown in Table 4, below.

TABLE 1

Composition of Alloys of Example 1

| Ingot | Si | Fe | Cu | Mn | Mg | Cr | Zn | Ti | V | Mg:Si |
|---|---|---|---|---|---|---|---|---|---|---|
| 1 (Inv.) | 0.43 | 0.19 | 0.14 | 0.096 | 0.61 | 0.032 | 0.013 | 0.019 | 0.009 | 1.40 |
| 2 (Comp.) | 0.81 | 0.19 | 0.14 | 0.143 | 0.71 | 0.032 | 0.013 | 0.019 | 0.009 | 0.88 |

TABLE 2

Mechanical Properties of Alloy 1 (Invention) of Example 1

| Natural Age Interval | Artificial Age Temp (° F.) | Artificial Age Time (hours) | Direction | TYS ksi (MPa) | UTS ksi (MPa) | U. Elong. (%) | T. Elong. (%) | CFS (%) |
|---|---|---|---|---|---|---|---|---|
| 1 month | None | None | L | 15.7 (108) | 25.92 (179) | 20.8 | 26.6 | 28.1 |
| | | | LT | 15.1 (104) | 25.035 (173) | 19.5 | 24.6 | 29.4 |
| | | | 45 | 15.5 (107) | 25.785 (178) | 23.0 | 29.9 | 26.2 |
| 3 months | 300 | 8 | L | 27.3 (188) | 37.1 (256) | 14.6 | 21.0 | 31.2 |
| | | | LT | 25.7 (177) | 35.7 (246) | 15.7 | 21.0 | 23.7 |
| | | | 45 | 26.0 (180) | 36.0 (248) | 16.4 | 21.4 | 22.9 |
| 3 months | 315 | 8 | L | 31.0 (214) | 39.2 (270) | 13.0 | 18.6 | 23.9 |
| | | | LT | 29.5 (204) | 37.8 (261) | 13.5 | 19.8 | 27.7 |
| | | | 45 | 29.8 (205) | 38.1 (262) | 14.1 | 20.0 | 21.1 |
| 35 days | 356 | 8 | LT | 34.6 (239) | 38.5 (266) | 7.9 | 9.9 | 30.8 |

TABLE 3

Mechanical Properties of Alloy 2 (Comparison) of Example 1

| Natural Age Interval | Artificial Age Temp (° F.) | Artificial Age Time (hours) | Direction | TYS ksi | UTS ksi | U. Elong. (%) | T. Elong. (%) | CFS (%) |
|---|---|---|---|---|---|---|---|---|
| 30 days | None | None | L | 22.9 | 37.2 | 20.8 | 26.2 | 23.1 |
| | | | LT | 21.6 | 35.8 | 20.9 | 26.5 | 19.1 |
| | | | 45 | 21.9 | 36.3 | 23.3 | 28.4 | 21.4 |
| 182 days | 356 | 2 | LT | 38.4 | 46.2 | 13.2 | 18.2 | 13.2 |

TABLE 4

Corrosion Resistance of Example 1 Alloys

| | | 24 hours - ASTM G110 Max depth of attack (μm) | | | | | |
|---|---|---|---|---|---|---|---|
| Alloy | Condition | 1 | 2 | 3 | 4 | 5 | Ave. |
| 1 (Inv.) | As Fabricated | 0 | 30 | 0 | 0 | 0 | 6 |
| 1 (Inv.) | 45 mins. @ 195° C. | 0 | 39 | 43 | 0 | 0 | 16 |
| 2 (Comp.) | As Fabricated | 0 | 15 | 0 | 0 | 0 | 3 |
| 2 (Comp.) | 45 mins. @ 195° C. | 36 | 15 | 32 | 20 | 29 | 26 |

As shown, the invention alloy (alloy 1) achieved improved properties over the comparison alloy (alloy 2). Specifically, with reference to tables 2 and 3, invention alloy 1 achieved improved critical fracture strain (CFS) over comparison alloy 2. For example, comparison alloy 2 after 30 days of natural aging and no artificial aging realized a CFS value of about 19% in the LT direction. In contrast, invention alloy 1 achieved improved critical fracture strain, realizing a CFS value of about 29% in the LT direction after 1 month of natural aging and no artificial aging. As another example, comparison alloy 2 after 182 days of natural aging and 2 hours of artificial aging at 356° F. realized a CFS value of about 13% the LT direction. In contrast, invention alloy 1 again achieved improved critical fracture strain, realizing a CFS value of about 28% in the LT direction after 3 months of natural aging and 8 hours of artificial aging at 315° F. Thus, the invention alloy achieved improved critical fracture strain (CFS) in the aged condition.

Higher critical fracture strain (CFS) values may correlate with improved crush properties. For example, a material (e.g., an aluminum alloy) which realizes a higher CFS value may also generally realize improved resistance to cracking in the tight folds of the material that may occur as a result of a crushing force. In one embodiment, alloys realizing a CFS value of at least 20% may be resistant to cracking (e.g., no cracking) in the tight folds produced by a crushing force.

As shown in table 4, invention alloy 1 achieved improved corrosion resistance over comparison alloy 2 after both alloys were artificially aged. For example, comparison alloy 2 after artificial aging for 45 minutes at 195° C. realized an average depth of attack of 26 μm. In contrast, invention alloy 1 achieved improved corrosion resistance, realizing an average depth of attack of 16 μm after artificial aging for 45 minutes at 195° C., and with corrosion resistance occurring at only 2 sites (sites 2 and 3). Thus, the invention alloy achieved an improved combination of, for instance, critical fracture strain and corrosion resistance.

Example 2—Additional Industrial Scale Testing

An additional invention alloy ingot (alloy 3) was cast as an ingot, the composition of which is shown in Table 5, below.

TABLE 5

Composition of Example 2 Alloy

| Ingot | Si | Fe | Cu | Mn | Mg | Cr | Zn | Ti | Ni | Mg:Si |
|---|---|---|---|---|---|---|---|---|---|---|
| 3 (Inv.) | 0.44 | 0.18 | 0.14 | 0.10 | 0.60 | 0.02 | 0.02 | 0.02 | — | 1.36 |

After casting, the alloy 3 ingot was scalped, and then homogenized. The ingot was then hot rolled to an intermediate gauge, then annealed at 800° F. for 1 hour, and then cold rolled to two different final gauges of 2.0 mm (0.0787 inch) and 3.0 mm (0.118 inch). The rolled products were then solution heat treated at a temperature and for a time such that substantially all of $Mg_2Si$ of the rolled product was dissolved into solid solution. The rolled products were then immediately cold water quenched, and then naturally aged for about two months. The rolled products were then artificially aged at various temperatures for about 27 hours. Some of the rolled products were then stretched about 2% while others of the rolled products were not stretched. Various ones of the products (both stretched and un-stretched) were then subjected to a simulated paint bake for 20 minutes at either 180° C. (356° F.) at 185° C. (365° F.). The mechanical properties of the rolled products were then tested. The processing conditions for the various alloys are provided in Table 6, below. The mechanical properties are provided in Table 7, below.

TABLE 6

Post-Rolling Processing Conditions for Example 2 Alloys

| Alloy | Final Gauge (mm) | Artificially Aging Temp. ° C./(° F.) for ~27 hours | Stretch | Simulated Paint Bake |
|---|---|---|---|---|
| 3A-1 | 2.0 | 146.1/(295) | None | None |
| 3A-2 | 2.0 | 137.8/(280) | None | None |
| 3A-3 | 3.0 | 146.1/(295) | None | None |
| 3A-4 | 3.0 | 137.8/(280) | None | None |
| 3B-1 | 2.0 | 146.1/(295) | None | 20 mins. at 180° C. |
| 3B-2 | 2.0 | 137.8/(280) | None | 20 mins. at 180° C. |
| 3B-3 | 3.0 | 146.1/(295) | None | 20 mins. at 180° C. |
| 3B-4 | 3.0 | 137.8/(280) | None | 20 mins. at 180° C. |
| 3C-1 | 2.0 | 146.1/(295) | 2% | 20 mins. at 180° C. |
| 3C-2 | 2.0 | 137.8/(280) | 2% | 20 mins. at 180° C. |

TABLE 6-continued

Post-Rolling Processing Conditions for Example 2 Alloys

| Alloy | Final Gauge (mm) | Artificially Aging Temp. ° C./(° F.) for ~27 hours | Stretch | Simulated Paint Bake |
|---|---|---|---|---|
| 3C-3 | 3.0 | 146.1/(295) | 2% | 20 mins. at 180° C. |
| 3C-4 | 3.0 | 137.8/(280) | 2% | 20 mins. at 180° C. |
| 3D-1 | 2.0 | 146.1/(295) | 2% | 20 mins. at 185° C. |
| 3D-2 | 2.0 | 137.8/(280) | 2% | 20 mins. at 185° C. |
| 3D-3 | 3.0 | 146.1/(295) | 2% | 20 mins. at 185° C. |

TABLE 6-continued

Post-Rolling Processing Conditions for Example 2 Alloys

| Alloy | Final Gauge (mm) | Artificially Aging Temp. ° C./(° F.) for ~27 hours | Stretch | Simulated Paint Bake |
|---|---|---|---|---|
| 3D-4 | 3.0 | 137.8/(280) | 2% | 20 mins. at 185° C. |

TABLE 7

Mechanical Properties of Example 2 Alloys

| Alloy | Final Gauge (mm) | Direction | TYS (MPa) | UTS (MPa) | U. Elong. (%) | T. Elong. (%) | CFS (%) |
|---|---|---|---|---|---|---|---|
| 3A-1 | 2.0 | L | 227 | 285 | 13.3 | 18.8 | 22.5 |
| 3A-1 | 2.0 | LT | 219 | 275 | 13.8 | 19.3 | 26.8 |
| 3A-1 | 2.0 | 45 | 220 | 276 | 14.2 | 20.3 | 20.8 |
| 3A-2 | 2.0 | L | 205 | 272 | 14.9 | 22.0 | 29.5 |
| 3A-2 | 2.0 | LT | 197 | 263 | 15.6 | 21.5 | 27.2 |
| 3A-2 | 2.0 | 45 | 198 | 263 | 16.4 | 21.6 | 22.6 |
| 3A-3 | 3.0 | L | 228 | 283 | 13.4 | 19.8 | 27.1 |
| 3A-3 | 3.0 | LT | 222 | 276 | 13.6 | 20.4 | 27.8 |
| 3A-3 | 3.0 | 45 | 223 | 276 | 14.0 | 21.0 | 21.2 |
| 3A-4 | 3.0 | L | 208 | 272 | 14.6 | 20.7 | 27.5 |
| 3A-4 | 3.0 | LT | 202 | 264 | 15.0 | 21.7 | 28.8 |
| 3A-4 | 3.0 | 45 | 203 | 266 | 16.0 | 22.4 | 22.7 |
| 3B-1 | 2.0 | LT | 218 | 271 | 13.3 | 18.9 | 24.8 |
| 3B-2 | 2.0 | LT | 200 | 260 | 14.0 | 19.7 | 24.1 |
| 3B-3 | 3.0 | LT | 221 | 272 | 12.8 | 19.8 | 26.5 |
| 3B-4 | 3.0 | LT | 206 | 263 | 13.5 | 20.3 | 27.2 |
| 3C-1 | 2.0 | LT | 245 | 279 | 11.4 | 16.7 | 25.4 |
| 3C-2 | 2.0 | LT | 234 | 274 | 12.4 | 18.2 | 32.2 |
| 3C-3 | 3.0 | LT | 248 | 280 | 11.2 | 17.7 | 29.7 |
| 3C-4 | 3.0 | LT | 238 | 275 | 11.6 | 19.3 | 28.8 |
| 3D-1 | 2.0 | LT | 247 | 278 | 10.8 | 16.8 | 30.9 |
| 3D-2 | 2.0 | LT | 236 | 273 | 11.6 | 17.4 | 27.2 |
| 3D-3 | 3.0 | LT | 249 | 280 | 10.6 | 18.2 | 29.2 |
| 3D-4 | 3.0 | LT | 240 | 276 | 11.4 | 18.2 | 28.0 |

As shown, the invention alloy realized an unexpectedly improved combination of strength, ductility and crush resistance. As shown, the invention alloy realized high CFS values (e.g., above 20%) for both the 2.0 mm and the 3.0 mm products. Further the CFS values were not negatively impacted by the application of the simulated paint bake (with or without 2% stretch), and thus would still be expected to show good cracking resistance upon application of a crushing force.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A recrystallized 6xxx aluminum alloy product consisting of:

0.30-0.53 wt. % Si;

0.50-0.65 wt. % Mg;

wherein a ratio of wt. % Mg to wt. % Si is at least 1.05:1 (Mg:Si);

0.05-0.24 wt. % Cu;

0.05-0.14 wt. % Mn;

0.05-0.25 wt. % Fe;

up to 0.15 wt. % Ti;

up to 0.15 wt. % Zn;

up to 0.15 wt. % Zr;

not greater than 0.04 wt. % V;

not greater than 0.04 wt. % Cr;

the balance being aluminum and other elements, wherein each of the other elements does not exceed 0.10 wt. % in the recrystallized 6xxx aluminum alloy product, wherein a total of the other elements is not more than 0.30 wt. % in the recrystallized 6xxx aluminum alloy product;

wherein the recrystallized 6xxx aluminum alloy product is a sheet product; and wherein the recrystallized 6xxx aluminum alloy product realizes a typical long-transverse (LT) tensile yield strength of at least 200 MPa and a critical fracture strain (CFS) of at least 25% in an artificially aged condition.

2. The recrystallized 6xxx aluminum alloy product of claim 1 having 0.35-0.50 wt. % Si.

3. The recrystallized 6xxx aluminum alloy product of claim 1 having 0.40-0.50 wt. % Si.

4. The recrystallized 6xxx aluminum alloy product of claim 1 having 0.55-0.65 wt. % Mg.

5. The recrystallized 6xxx aluminum alloy product of claim 1, wherein the ratio of wt. % Mg to wt. % Si is at least 1.10:1.

6. The recrystallized 6xxx aluminum alloy product of claim 1, wherein the ratio of wt. % Mg to wt. % Si is at least 1.20:1.

7. The recrystallized 6xxx aluminum alloy product of claim 1, wherein the ratio of wt. % Mg to wt. % Si is at least 1.30:1.

8. The recrystallized 6xxx aluminum alloy product of claim 1, wherein the ratio of wt. % Mg to wt. % Si is not greater than 1.75:1.

9. The recrystallized 6xxx aluminum alloy product of claim 1 having not greater than 0.22 wt. % Cu.

10. The recrystallized 6xxx aluminum alloy product of claim 1 having not greater than 0.20 wt. % Cu.

11. The recrystallized 6xxx aluminum alloy product of claim 1 having not greater than 0.19 wt. % Cu.

12. The recrystallized 6xxx aluminum alloy product of claim 1 having at least 0.07 wt. % Cu.

13. The recrystallized 6xxx aluminum alloy product of claim 1 having at least 0.09 wt. % Cu.

14. The recrystallized 6xxx aluminum alloy product of claim 1 having at least 0.11 wt. % Cu.

15. The recrystallized 6xxx aluminum alloy product of claim 1 having 0.06-0.13 wt. % Mn.

16. The recrystallized 6xxx aluminum alloy product of claim 1 having 0.07-0.12 wt. % Mn.

17. The recrystallized 6xxx aluminum alloy product of claim 1 having not greater than 0.03 wt. % each of V and Cr.

18. The recrystallized 6xxx aluminum alloy product of claim 1 having not greater than 0.02 wt. % V.

19. The recrystallized 6xxx aluminum alloy product of claim 1 having not greater than 0.02 wt. % Cr.

20. The recrystallized 6xxx aluminum alloy product of claim 1, wherein the sheet product has a thickness of from 1.5 mm to 4.0 mm.

* * * * *